US008747155B2

(12) United States Patent
Weber et al.

(10) Patent No.: US 8,747,155 B2
(45) Date of Patent: Jun. 10, 2014

(54) UNDERFILL APPLICATOR DEVICE AND METHODS FOR ASSEMBLING ELECTRICAL CONTACTS

(75) Inventors: Douglas J. Weber, Arcadia, CA (US); Naoto Matsuyuki, Nagoya (JP)

(73) Assignee: Apple Inc., Cupertino, CA (US)

( * ) Notice: Subject to any disclaimer, the term of this patent is extended or adjusted under 35 U.S.C. 154(b) by 64 days.

(21) Appl. No.: 13/607,502

(22) Filed: Sep. 7, 2012

(65) Prior Publication Data

US 2014/0073201 A1 Mar. 13, 2014

(51) Int. Cl.
*H01R 13/66* (2006.01)

(52) U.S. Cl.
USPC ..... 439/589; 439/936

(58) Field of Classification Search
USPC ..... 439/587–589, 936
See application file for complete search history.

(56) References Cited

U.S. PATENT DOCUMENTS 3,744,128 A * 7/1973 Fisher et al. ..... 29/858
5,630,732 A * 5/1997 Yamanashi ..... 439/589
7,217,157 B2 * 5/2007 Onoda et al. ..... 439/589
7,377,808 B2 * 5/2008 Gentry ..... 439/578
7,390,217 B2 * 6/2008 Scott ..... 439/604
2007/0077828 A1 * 4/2007 Kurahashi ..... 439/936
2013/0344736 A1 * 12/2013 Taguchi et al. ..... 439/587

* cited by examiner

*Primary Examiner* — Gary Paumen
(74) *Attorney, Agent, or Firm* — Kilpatrick Townsend & Stockton LLP

(57) ABSTRACT

Devices and methods for assembling a connector are provided herein. In one aspect, an example method of assembly includes positioning an insert frame having an applicator portion supporting electrode contacts within an enclosure; attaching the electrode contacts to a circuit board substrate within the enclosure; forming an underfill layer by injecting a hardenable fluid medium through the applicator portion to fill a semi-confined space between the insert frame and the circuit board substrate; and detaching the applicator portion and applying an overmold. The applicator portion includes one or more lumens extending from an inlet opening to one or more exit openings to facilitate flow of fluid medium to desired locations. The inlet opening may be disposed on a portion of the applicator extending above the insert frame and have a diameter substantially larger than the exit opening to allow for fluid injection using an oversized injection nozzle.

25 Claims, 11 Drawing Sheets

UNDERFILL APPLICATOR DEVICE AND METHODS FOR ASSEMBLING ELECTRICAL CONTACTS

BACKGROUND

Electrical connectors can be used to exchange data between devices such as computers and peripheral devices, including portable media devices. For example, music, phone numbers, video, and other data can be exchanged among these devices over a cable that carries information between devices and connects to each such device using an electrical connector.

Often a connector system includes corresponding male and female connectors. For example, a connector plug (male connector) on an end of a data cable may be inserted into a connector receptacle (female portion) located on a computer or portable media device. As devices are continuously being made smaller and more compact, there is a desire to make electrical connectors smaller and more compact as well. Manufacturing such smaller connectors presents challenges that may not be present when manufacturing larger connectors.

SUMMARY

Embodiments of the invention provide methods of assembling improved connector plugs that overcome the drawbacks of the assembly methods described above. In one aspect, the invention allows for improved connector plugs having an insert for assembling electrical contacts within an enclosure of a connect plug that allows that facilitates flow of a fluid medium in spaces that are not easily accessible.

In one aspect, the portion of the insert is interfaceable with an applicator nozzle and is detachable after flow of the fluid medium using the insert is complete. In some embodiments, the insert comprises a dielectric frame that support a plurality of electrical contacts within the enclosure during soldering of the electrical contacts. The dielectrical frame includes one or more portions having a lumen through which a fluid medium can flow into spaces beneath or around the dielectrical frame and electrical contact that are not easily accessible to facilitate flow of the fluid medium after the electrical contacts are positioned in the enclosure, such as after soldering is complete. In one aspect, the insert includes an applicator portion comprises a nozzle feature having a lumen extending therethrough from an inlet opening to an exit opening. When positioned within the enclosure with electrical contacts supported therein, the inlet opening is accessible from above the enclosure and the exit opening is disposed near a space between the electrical contacts and an attached circuit board substrate disposed in the enclosure to facilitate flow of a fluid medium, such as a hardenable underlayer material, lubricant, solder, or other fluid medium. In some embodiments, the applicator portion facilitates flow of a hardenable medium, including but not limited to various thermoplastic injection compounds; thermoplastics, such as polyurethanes, polyester and PVC/nitrile; thermoplastic rubbers; and epoxies. The applicator portion may be integrated within an electrical contact support frame and is detachable therefrom so that after application of the fluid medium is completed, the applicator portion can be removed and assembly of the connector can be completed.

In an embodiment, the applicator portion comprises a plurality of lumens extending from one or more inlet opening to one or more exit opening. An applicator portion comprising a plurality of lumens may be used to facilitate flow of a fluid medium, such as solder, lubricant, or a hardenable underfill material, to a plurality of differing location or to facilitate more uniform flow of a common space. A plurality of lumens may be used to facilitate flow of solder from at least one inlet opening to separate locations between each of the electrical contacts and the circuit board substrate to facilitate soldering and electrical coupling between the electrical contacts and circuit board.

In some embodiments, the applicator portion may comprise a plurality of applicator portions configured for the same or different functions. For example, the insert may include a first applicator portion to facilitate flow of fluid solder between the electrical contacts, a second applicator portion to facilitate flow of a hardenable fluid filling medium to form an underfill layer, and/or a third applicator portion to facilitate flow of a fluid lubricant to one or more locations within the connector or receptacle that are difficult to access.

In another aspect, the present invention includes methods for assembling an electrical connector comprising: positioning an insert frame supporting a plurality of electrical contacts within an enclosure of a connector plug; attaching the electrical contacts to a circuit board substrate within the disclosure; and forming an underfill layer between the insert frame and the circuit board substrate by delivering a fluid medium through an applicator portion of the insert frame; and optionally detaching the applicator portion after delivering the fluid medium therethrough. Similar principles may be utilized for delivery of a fluid medium for a variety of different purposes, such as delivering a liquid solder, sealant, or lubricant to various locations during or after assembly.

Various embodiments of the present invention may incorporate one or more of these and the other features described herein. A better understanding of the nature and advantages of the present invention may be gained by reference to the following detailed description and the accompanying drawings.

DETAILED DESCRIPTION

Embodiments of the present invention generally relate to assembly of electrical contacts, and in particular connector plugs. More specifically, the present invention relates to assembly of connector plugs having multiple electrical contacts supported within an insert or frame within an enclosure, in some embodiments with a bottom surface of the electrical contacts coupled to a circuit board substrate, such as a printed circuit board (PCB), disposed within the enclosure. In one aspect, the insert includes an applicator portion having a lumen extending therethrough to facilitate flow of a fluid medium through the applicator from an upper side of the insert to a space adjacent the bottom side of the insert when disposed within the enclosure. The applicator portion may be removable so that after a fluid medium is deposited through the insert, the applicator portion can be detached and removed to complete assembly of the connector. In another aspect of the invention, methods of assembling a connector plug are provided.

Accordingly, the present invention provides devices and methods for assembling electrical contacts within a connector plug that allow improved delivery of fluid mediums, such as a hardenable fluid for use as an underfill layer, into spaces that are not easily accessible. By providing for improved delivery of a fluid medium to such spaces during assembly, the present invention allows for connector plugs having improved strength and performance. Delivery of a hardenable fluid medium in spaces below the insert and electrical contacts aids in securing the soldered electrical contacts in place. The hardenable fluid medium may comprise a dielectric or insulating material so as to inhibit flow of electric current through spaces between the electrical contacts and the circuit board substrate. In some instances, the applicator portion extends a distance above the insert and includes an upper inlet opening that is larger than an exit opening adjacent the bottom side of the insert to allow for improved for use of an oversized injection nozzle to dispsense the fluid medium. Examples of the above described connector plugs, the claimed methods for assembly, and the claimed inserts having applicator portions for use with such methods are shown in the following figures. These figures, as with the other figures herein, are shown for illustrative purposes and do not limit either the possible embodiments of the present invention or the claims.

Figure 1:
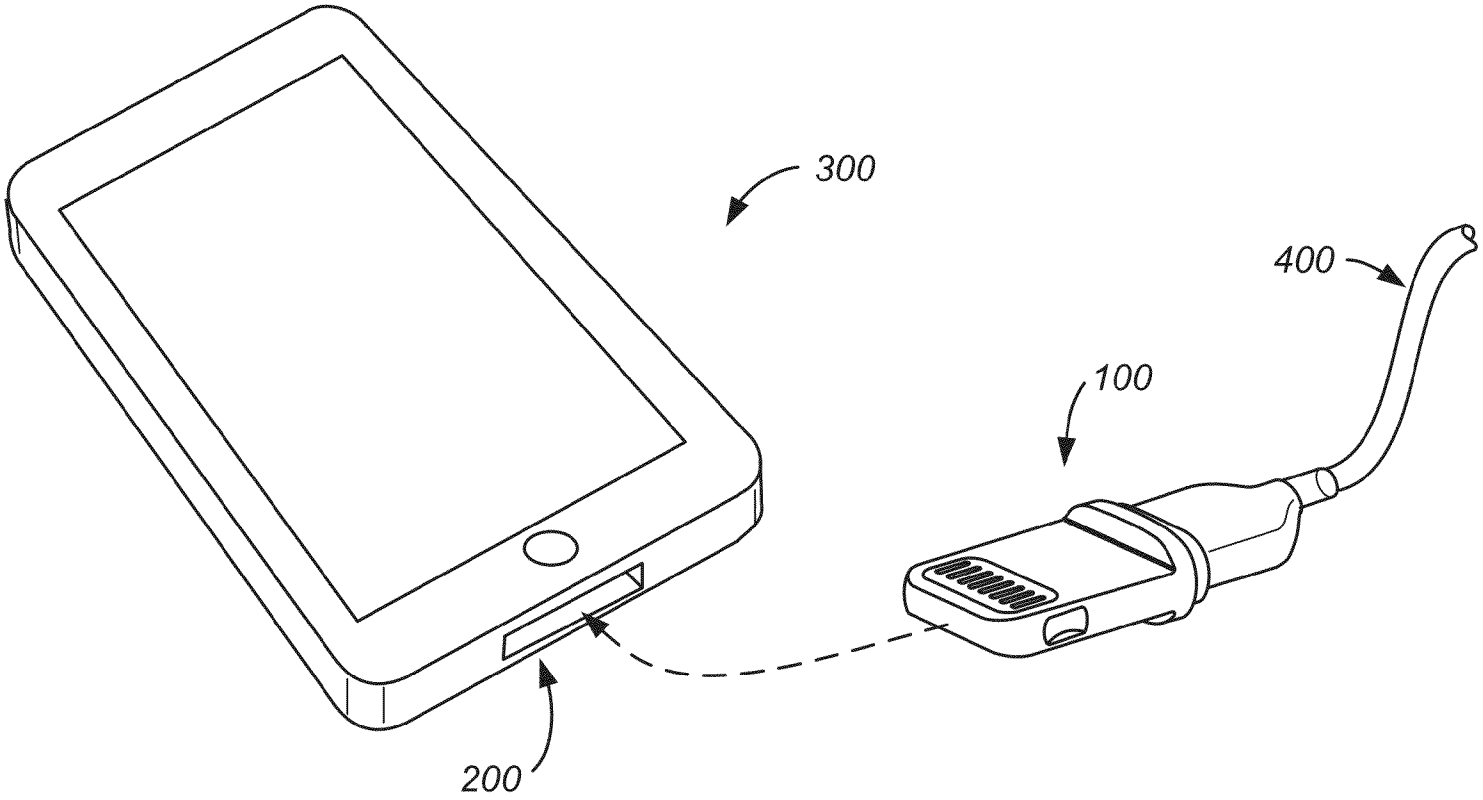
FIG. 1 illustrates a media device and associated data cord, which includes a connector plug that may be assembled in accordance with an embodiment of the present invention.

FIG. 1 illustrates an exemplary connector plug 100, the assembly of which may be improved by incorporation of embodiments of the present invention. This figure shows a media device 300 and associated data cord 400 that can be connected by connector plug 100 of the data cord and the connector receptacle 200 of the media device. By inserting the connector plug 100 within the connector receptacle 200 of the media device, a group of electrical contacts on the connector plug engage a corresponding group of electrical contacts within the receptacle. Although the electrical contacts assembled in accordance with the present invention are shown disposed in a connector plug 100 of data cable 400 for use with a media device, the present invention may be used in any of a variety of devices or components having electrical contacts, including but not limited to the tongue of a connector receptacle. Generally, the connector 100 is connected and disconnected frequently over time such that interfacing surfaces of the connector plug 100 and receptacle 200 may create friction and cause wear-and-tear on the electrical contacts and associated components, thereby degrading the performance of the connector and reducing the life-span of the connector device.

Figure 2:
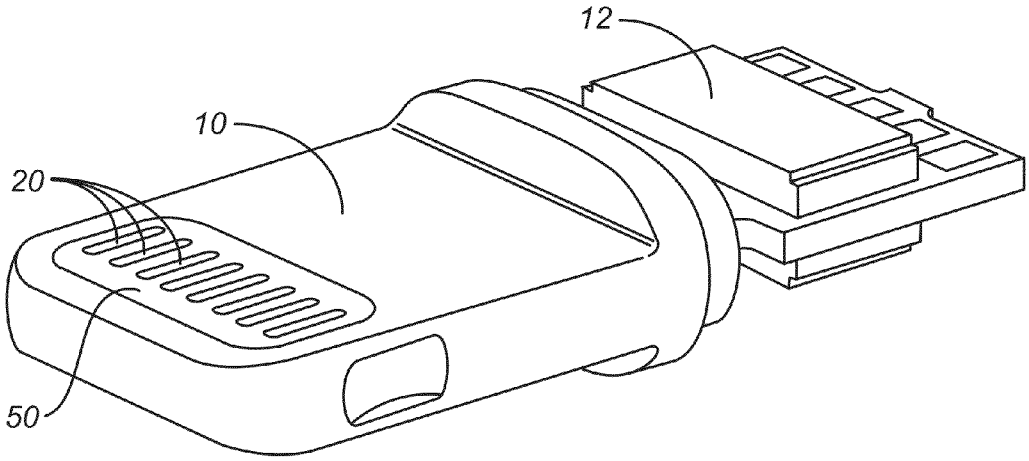
FIG. 2 illustrates an example connector plug assembled in accordance with an embodiment of the present invention.

FIG. 2 illustrates the exemplary connector plug 100 of FIG. 1 in greater detail. The connector plug 100 includes an insertable tab portion 44 that is received within a cavity of the connector receptacle. The insertable tab portion 44 of connector plug 100 includes an enclosure that houses the group of parallel electrical contacts and their associated components. In one embodiment, the enclosure is a structural member having a metalshell and a hollowed interior in which electrical components of the connector can be inserted, sometimes referred to as a ground ring. In some embodiments the components of the connector plug are relatively small and assembling the electrical contacts within the plug enclosure while maintaining the proper position of each electrical contact and planarity of the contact surfaces can be a complex task. As an example, in one embodiment connector plug 100 has an insertion depth and width of less than 10 mm each and a thickness of less 2 mm. In another embodiment the insertion portion of connector plug 100 is 6.65 mm×6.65 mm×1.5 mm. Any minor irregularities during assembly of such connectors may cause the electrical contacts to not be co-planar or to be mis-aligned which can be detrimental to the operation of the connector. Thus, it is desirable to attach the electrical contacts within the enclosure in a precise position, such as by use of an insert frame, and further, to maintain those positions by securing the contacts throughout the lifetime of the connector.

To improve strength and performance of the electrical components to withstand such wear-and-tear between components and ensure connectivity between corresponding contact surfaces, it is advantageous to include an underfill layer (not visible in FIG. 2) below and around the electrical contacts to help secure their position arid attachment to the circuit board substrate to the connector (e.g. by soldering). While various methods can be used to deliver an underfill material, such as injecting the hardenable fluid medium, assembly of the electrical connector can create relatively small spaces within the connector that are difficult to access when injecting underfill. After the underfill layer is formed, an overmold layer 50 is formed around the sides of the contacts and over the insert frame to further protect the electrical contacts and provide a flush interfacing surface, thereby completing assembly of the connector plug.

Since assembly of the connector plug can create spaces within the connector plug that can be somewhat confined, injecting an underfill material around the edges of the insert frame can result in air bubbles trapped in the semi-confined spaces created between the insert, electrical contacts and enclosure, which prevents uniform flow of underfill material around the electrical contacts and formation of the underfill layer. Given the very small dimensions of some connector plugs according to the present invention, accurate injection of underfill material is difficult, particularly since many injection nozzles may be oversized or larger than the access spaces within a partially assembled connector plug. It would be desirable to provide a simple, reliable, consistent and efficient process by which a fluid medium can be delivered to such small spaces during assembly of the connector plug.

The methods and devices provided herein allow for assembly of such connector plugs by a simple, consistent, and efficient process that ensures the electrical contacts maintain their proper positions during subsequent use. While the example connector plug shown in the figures herein depicts an insert having an applicator portion to facilitate flow of a fluid medium into difficult to access spaces within the connector plug during assembly, one of skill in the art would appreciate that the methods and apparatus described herein could be used in any connector or device where flow of a fluid medium in difficult to access spaces is desired.

FIGS. 3A-3E illustrate the various components of an exemplary connector plug during assembly, although one of skill in the art would appreciate that these components may differ in alternative connector plugs and methods of assembly.

Figure 3A:
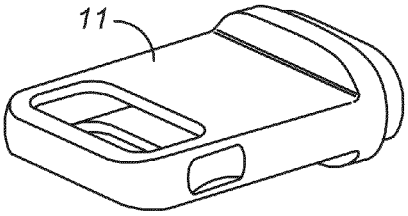
FIGS. 3A-3E illustrate components of an exemplary connector plug during assembly in accordance with an embodiment of the present invention.

FIG. 3A illustrates the connector plug enclosure shell 11 that can be made from metal or another suitable hard conductive material and sometimes referred to as a ground ring. The ground ring may be made from stainless steel, brass, or any number of other suitable materials, and includes an opening for an inserted circuit board substrate as well any associated components and electrical contacts. Although the outer top surface of the enclosure shell 11, near where the electrical contacts are inserted, may be flat, as shown, it may also be curved or angled in other embodiments.

Figure 3B:
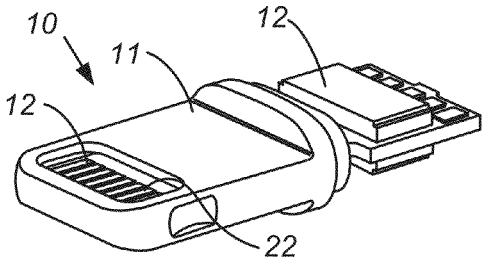

FIG. 3B illustrates the connector plug enclosure 10 having a circuit board substrate component 12 inserted within the enclosure shell 11. The circuit board insert 12 may extend through the interior of the enclosure shell 11 and through a rear portion for attachment to wires within the associated data cable. The circuit board insert 12 may be fixedly attached to the enclosure 10 according to any number of suitable means, including an interference fit, pins, soldering, or adhesive bonding. The portion of the circuit board insert 12 extending through the opening in the enclosure 10 includes electrical contact points corresponding to individual wires within the data cable, that may be soldered to the electrical contacts of the plug to establish connectivity between the electrical contacts and the data cord. In soldering parts together, solder is deposited on one or both of the surfaces to be soldered together. The circuit boardinsert 12 has a bonding pad for each of the contacts 20. Solder provides two functions: (1) providing electrical contact between each of external contacts 20 and its corresponding bonding pad; and (2) acting as a spacer for the contacts via the hotbar melting/hardening process described herein. As shown in 10 FIG. 3B, the solder may be deposited on the circuit board insert 12 at the desired electrical contact location to facilitate soldering of an electrical contact 20 to the circuit board insert 12 of the enclosure 10. To ensure the electrical contacts 20 are properly positioned at the desired electrical contact points for soldering, the insert frame or other such alignment device may be used.

Figure 3C:
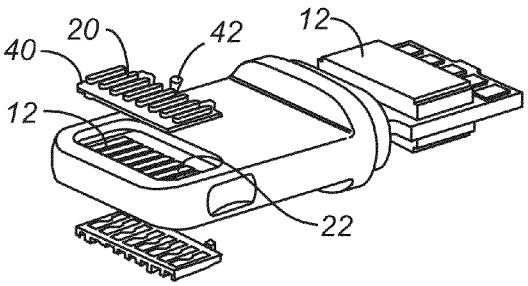

FIG. 3C illustrates the above assembly as well as a group of electrical contacts 20 positioned in a dielectric frame 40 before insertion into the opening of the enclosure 10. The frame 40 may use any number of means for aligning the electrical contacts 20 in the proper positions relative to each other and the enclosure 10, including dimensioning, pins, holes, etc. The frame 40 aligns the electrical contacts by engaging the sides of the electrical contacts while allowing for contact between the bottom of the electrical contacts 20 and the solder deposits 22 so as to facilitate soldering of the contacts 20 to the enclosure 10 and maintain electrical contact therebetween. The frame 40 further includes an applicator portion 42 having a lumen for delivering a flow of fluid medium from an upper side of the insert 40 to a space beneath the insert 40 when positioned within the enclosure. As can be seen, the applicator portion 42 may extend a distance above the upper surface of the insert frame 40.

The ground ring may be fabricated from one or more metals, such as stainless steel, more layers, such as a stainless steel, copper alloy, or phosphor bronze, and may include additional coatings such as palladium, nickel, and gold platings. The solder may be a pliable paste than can be easily deposited on a surface of the circuit board insert 12 or the bottom surface of the electrical contact 20 prior to soldering. Generally, the solder is a combination of materials, which may include tin, silver and copper, and additives to facilitate soldering of the contacts to the circuit board insert. The solder deposit 22 is pliable during assembly or when melted such that the electrical contact 20 can be pressed against the solder deposit 22 until a top surface of the contact 20 is coplanar with the surrounding contacts 20.

Figure 3D:
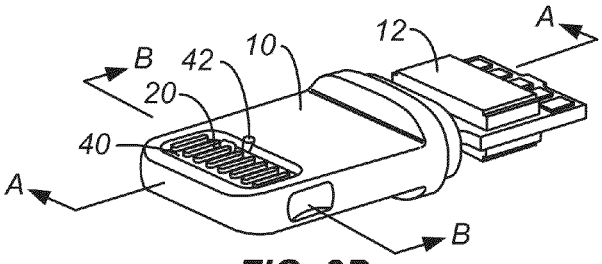

FIG. 3D illustrates the enclosure 10 with the group of electrical contacts 20 positioned within using the frame 40. In some embodiments, the frame 40, when used, remains within the enclosure 10 after soldering of the contacts 20 within the enclosure 10, however, in some embodiments, the frame 40 may be removed before or after soldering. Once the electrical contacts 20 are positioned as desired within the enclosure 10 as shown in FIG. 3D, the electrical contacts 20 are attached to the circuit board insert (e.g. such as by soldering with a heated hot bar advanced toward the enclosure 10 so as to contact the top surfaces of the electrical contacts 20 and planarize the contacts while concurrently melting the solder so as to solder and electrically connect the contacts with the circuit board insert 12 in the enclosure 10.

As shown in FIG. 3D, once electrical contacts 20 disposed within soldered to the circuit board insert 12, an underfill layer is formed around the solder and lower portions of the electrical contacts 20 to further strengthen the attachment, maintain the positions of the electrical contacts 20 and can be used to inhibit undesired current flow through spaces between the electrical contacts. In one aspect, the underfill layer is formed by injecting a hardenable fluid medium, such as an injectable thermoplastic or epoxy, into the desired area. To facilitate injection of the fluid medium into the cavity, the applicator portion 42 of the insert 40 extends above the upper surface of the insert 40 to allow for easy access from outside of the enclosure. An injection nozzle having an exit orifice unsuitably large for injection of fluid into such a small cavity interfaces with the inlet opening of the applicator portion 42 so that the injected fluid medium flows through a lumen of the applicator portion 42 and exits an exit opening adjacent the bottom side of the frame into the small, difficult to access areas beneath the insert 40 and between the bottom sides of the electrical contacts 20. Thus, the claimed insert 40 having an applicator portion 42 allows for ease of assembly using an oversized fluid injection nozzles in addition to increasing control over the direction of flow during injection. After flow of undermold material is complete, the applicator portion 42 may be detached and discarded.

Figure 3E:
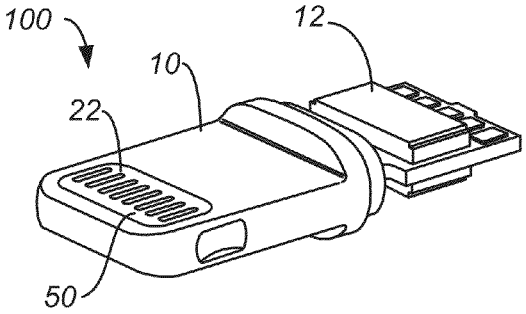

FIG. 3E illustrates the connector plug 100 after overmolding, usually with a nylon or polymer material, around the electrical contacts 20 and over the undermold layer. The overmold layer further protects the electrical contacts and improves the aesthetic appearance of the connector. FIG. 3E also depicts the cross-sections A-A and B-B, which correspond to the viewpoints in subsequent FIGS. 4-5.

In an exemplary embodiment, the method of assembling a connector plug includes positioning an insert having a plurality of electrical contacts disposed therein within an enclosure, attaching the electrical contacts at desired electrical contact locations on a circuit board substrate disposed within the enclosure, forming an underfill layer by injecting a hardenable fluid medium through an applicator portion of the insert so as to fill a space between the frame and the circuit board substrate, detaching the applicator portion, and depositing an overmold on the underfill. Generally, the method includes interfacing an injection nozzle with an inlet opening of the applicator portion and forcing the fluid medium through one or more lumens of the applicator portion to exit from one or more exit openings to fill the space. Alternatively, the method may include using an applicator portion to deposit liquid solder at desired locations to attach the electrical contacts or other components in the connector or to deposit a liquid lubricant at a desired location within the assembly, such as in a retention mechanism.

Figure 4:
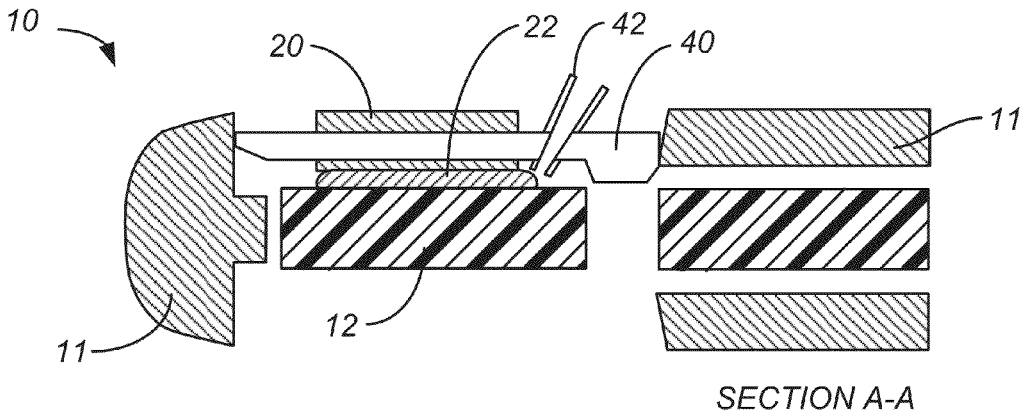
FIGS. 4-5 illustrate cross-sectional views of an exemplary connector plug during assembly in accordance with an embodiment of the present invention.
Figure 5:
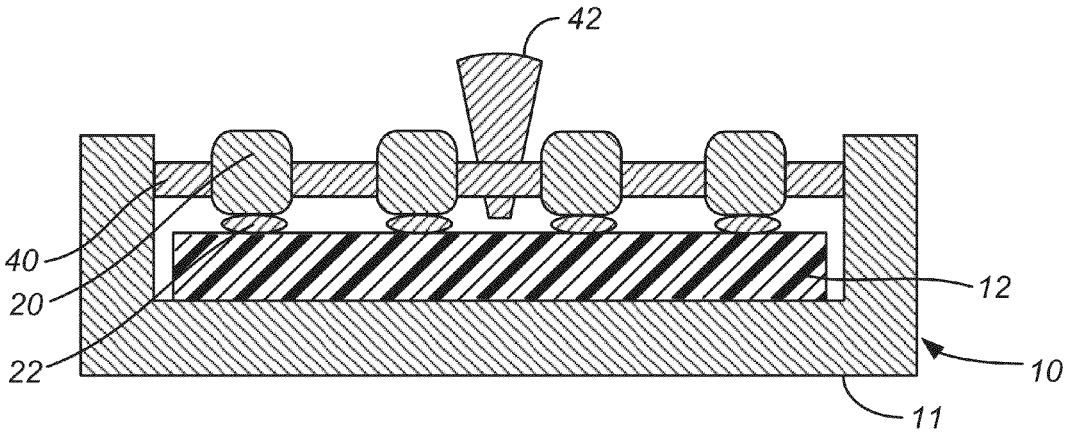

FIGS. 4-5 illustrate cross-sections of select components of the assembly in FIG. 3D. FIG. 4 depicts the enclosure 10 as it would appear along cross-section A-A, and FIG. 5 depicts the enclosure 10 as it would appear along cross-section B-B. As shown in each of FIGS. 4 and 5, the enclosure 10 includes a circuit board substrate 12 disposed therein, a plurality of electrical contacts 20 supported at pre-determined positions within an insert frame 40. The insert frame 40 is dimensioned so as to be fittingly received within the opening of the enclosure so that when inserted, each of the group of electrical contacts is positioned with the desired alignment and location for soldering. When supported within the insert fram 40, the bottom side of the electrical contacts 20 extend from the bottom side of the frame 40 and are electrically coupled to the circuit board substrate 12 by a plurality of solder deposits 22 disposed thereon. The insert frame 40 aids in alignment and positioning of the electrical contacts 20 to facilitate attachment of the electrical contacts 20 at desired locations on the circuit board substrate 12, such as by soldering with a heated hot bar or any of a variety of attachment methods.

As can be seen in each of FIGS. 4 and 5, the frame 40 includes an applicator portion 42 having a lumen extending therethrough, the lumen having an inlet opening and an exit opening. The applicator portion is generally made from a same or similar material as the insert frame and may be formed integrally with the insert frame 40, or may be formed separately and attached to the insert frame 40. The inlet opening is disposed at an upper portion of the applicator portion 42 so as to be accessible from outside the partially assembled connector plug while the exit opening is disposed adjacent the bottom side of the insert 40 so that a fluid medium flowing through the lumen is directed to the difficult to access space below the frame. Generally, the exit opening is smaller than the inlet opening, the inlet opening being dimensioned to interface with an injection nozzle, and the exit opening being of a suitable dimension to direct the flow of fluid medium to the desired locations.

Figure 6A:
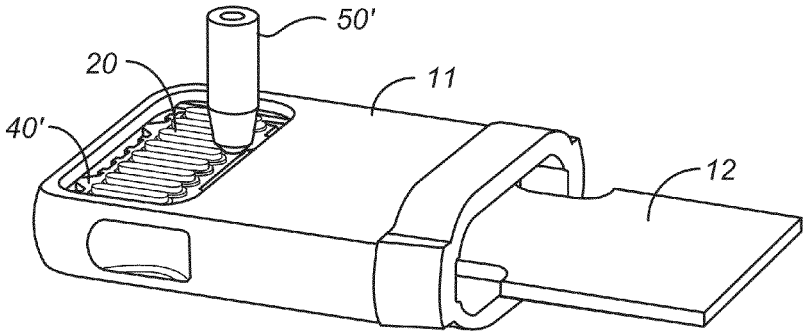
FIGS. 6A-6B illustrate an exemplary connector plug during assembly according to some methods.
Figure 6B:
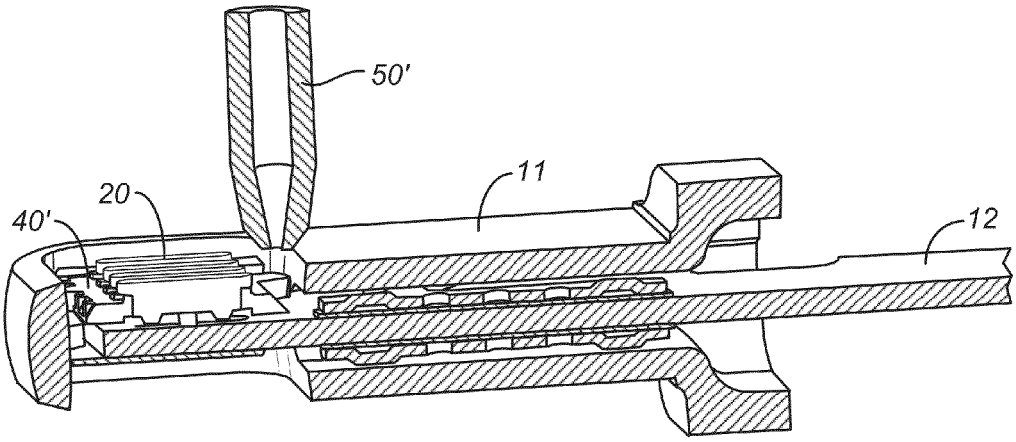

FIGS. 6A-6B illustrate steps that would be associated with depositing an underfill layer in a similar connector plug without the benefit of the present invention. In FIGS. 6A and 6B, an oversizedinjection nozzle 50' is shown positioned adjacent the area in which the underfill layer is desired. As can be seen, however, due to the relatively small dimensions of the assembly and limited clearance between an insert frame 40' and the enclosure 11, the exit opening of the injection nozzle 50' is positioned a distance away from the space in which underfill is desired. As a result, flow of underfill material through the nozzle 50' may inadvertenly flow into areas in which underfill is not desired, such as above the insert frame 40. Additionally, the small scale of the connector assembly relative the injection nozzle 50' makes positioning of the injection nozzle 50' more difficult.

Figure 7A:
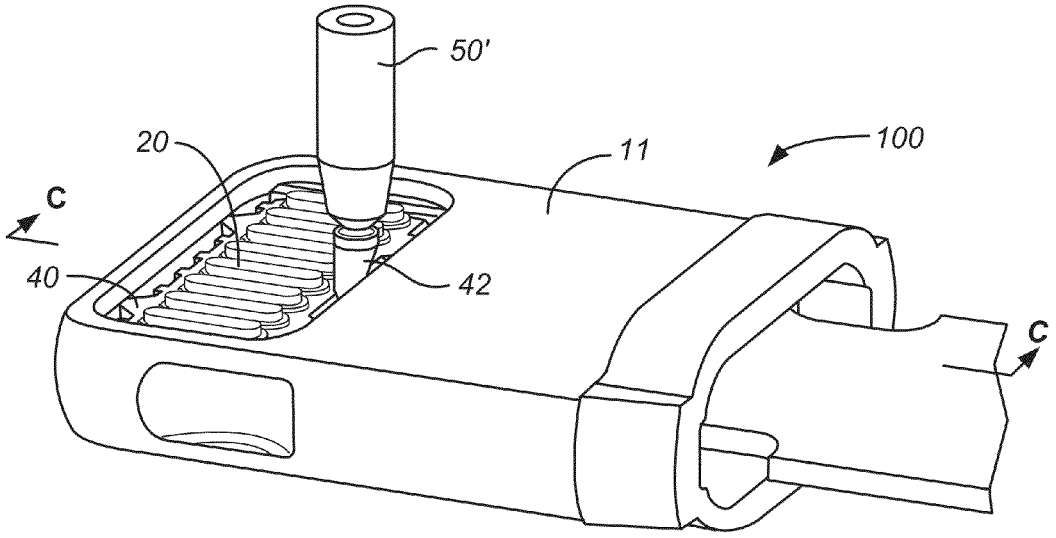
FIGS. 7A and 7B-7D illustrate an example connector plug with insert during assembly in accordance with an embodiments of the invention during assembly and examples of various inserts, respectively.
Figure 7B:
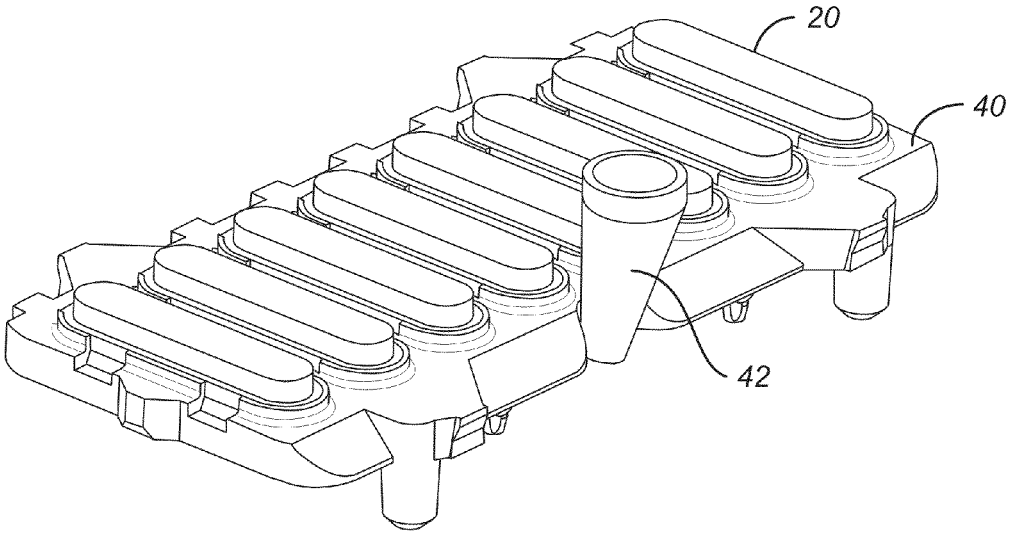
Figure 7C:
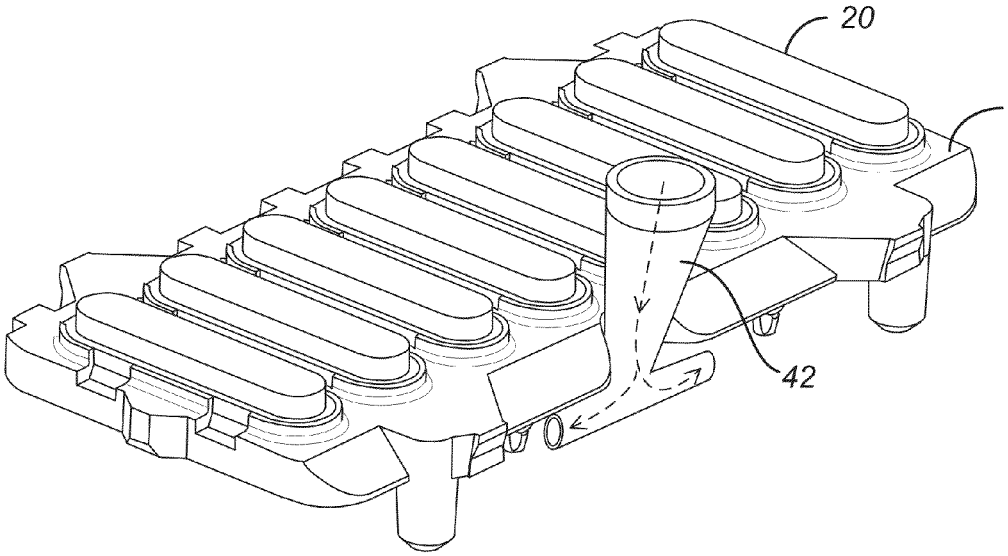
Figure 7D:
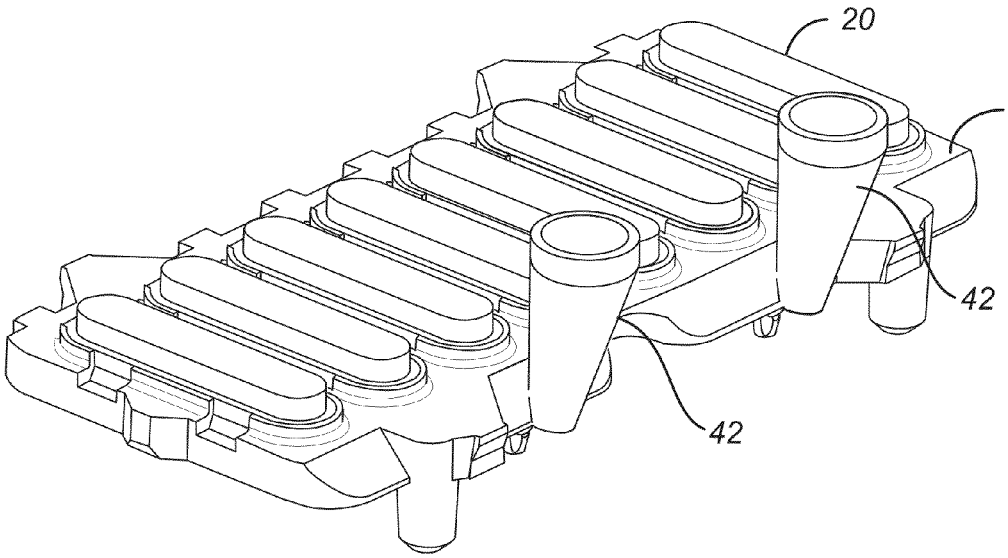

FIGS. 7A-7D illustrate an insert frame 40 having an applicator portion 42, in accordance with embodiments of the present invention. As can be seen, the claimed insert frame 40 allows for more controlled applicator of an underfillayer, or other fluid medium, at desired locations, even when used with an oversized injection nozzle 50'. As shown in FIG. 7A, the injection nozzle 50' can be interfaced with the inlet opening of the applicator portion 40, thereby improving the ease with which the injection nozzle is positioned and preventing inadvertent flow of a fluid medium injected with nozzle 50' into adjacent areas. As shown in FIG. 7B, the applicator portion 42 is attached to the insert frame 40 and includes a lumen for directing flow of a fluid medium from outside of the connector plug to a space below the insert frame. The applicator portion 42 may also aid in handling and positioning of the insert frame 40 during the assembly steps, such as those depicted in FIGS. 3A-34E. As shown, the diameter of the inlet opening of the applicator portion 42 is substantially greater than the exit opening of the applicator portion 42, so as to allow use of an oversizedinjection nozzle to inject fluid into a relatively small space with improved control. FIG. 7C shows an embodiment having a plurality of exit openings so that a fluid medium can be dispensed from multiple openings into different areas through a single inlet. This aspect may be useful in providing more uniform flow of a fluid medium, such as an underfill material, into a confined space or to provide flow of a fluid medium, such as solder, to separate, discrete locations. FIG. 7D shows an example insert 40 having an applicator portion 42 with multiple inlet opening 42*a*, 42*b* with separate exit openings. This aspect may be useful to allow different areas to be filled with a fluid medium from different nozzle, to allow different fluid mediums to flow into the same space, or to allow filling of a space from nozzles disposed in alternate locations. In some embodiments, the applicator portion 42 may include a first inlet portion 42*a* corresponding to one or more locations beneath the insert 40 and a second inlet portion 42*b* corresponding to one or more different locations. Such an embodiment may be used for delivering a first fluid medium, such as solder, through the first inlet portion to the bottom of each electrical contact beneath the insert, to facilitate soldering, and subsequent delivery of a second fluid medium, such as an underfill thermoplastic, to form an underfill layer around the soldered contacts.

Figure 8A:
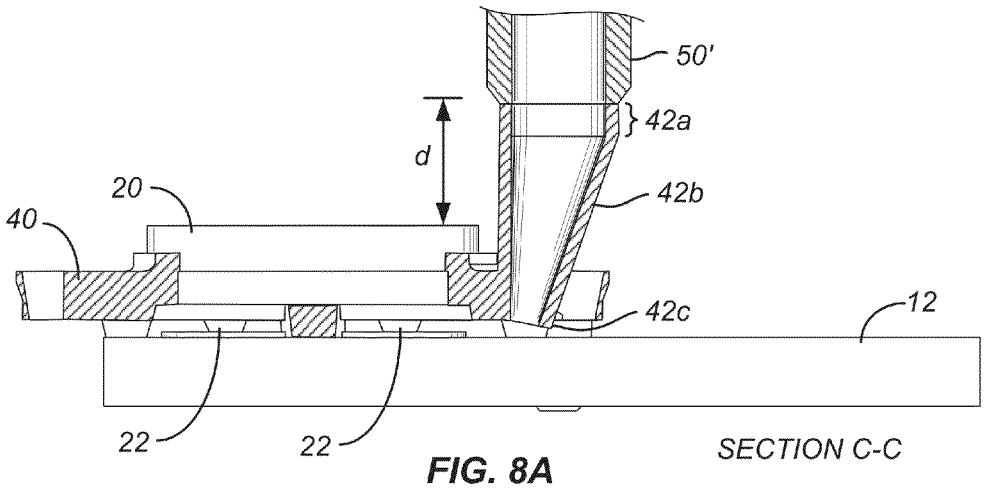
FIGS. 8A-8B illustrate cross-sectional views of select components of an exemplary connector plug during assembly in accordance with an embodiment.
Figure 8B:
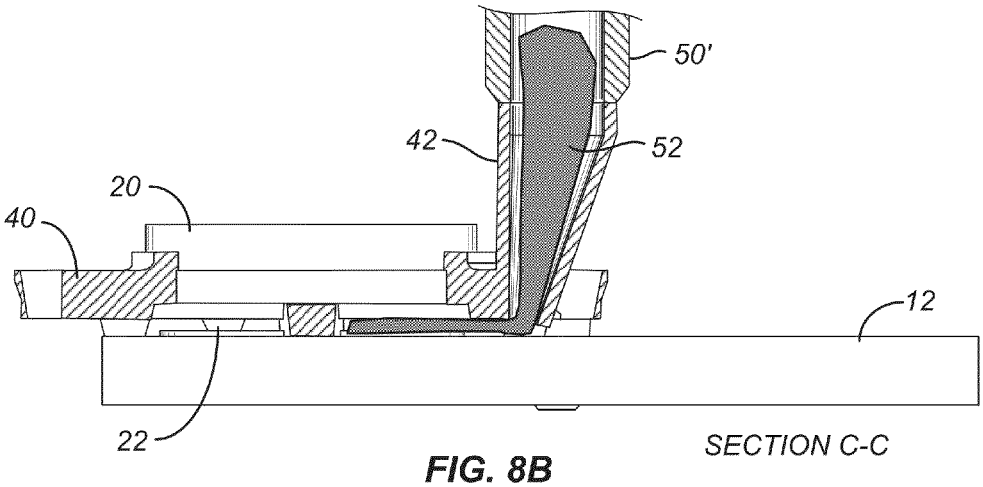

FIGS. 8A-8B illustrate a cross-sectional view of the assembly in FIG. 7 A along cross-section C-C before and during injecting of underfill material through applicator portion 42. As shown in FIG. 8A, an injection nozzle 50' is interfaced with the inlet opening of the applicator portion 42. In some embodiments, the nozzle extends a distance above the top surface of the electrode contacts or the outside surface of the enclosure so that the injection nozzle 50' does not have to be inserted into an area with limited clearance. In an embodiment, the applicator portion 42 extends about 1-25 mm above the top surface of the electrode contacts or enclosure, such as about 5-10 mm, to provide sufficient clearance. This aspect allows use of an injection nozzle 50' that would otherwise be unsuitable for injection into small spaces or inaccessible areas. In some embodiments, the applicator portion 42 includes an inlet portion 42*a* having a suitable dimension for use with any of a variety of injection nozzles, a narrowing portion 42*b* that reduces in diameter to a suitable dimension to allow flow of a fluid medium to a desired area, and an exit portion 42*c* that includes one or more exit opening for dispensing the fluid medium into the desired location (e.g. below the insert frame 40). In some embodiments, the diameter of the inlet opening is substantially larger than the diameter of the one or more exit opening, such as 50% to 500% greater, such as 200-300% greater. The inlet portion may have a constant diameter, may be angled, or may include various features to aid in interfacing with a dispensing portion of the injection nozzle.

FIG. 8B illustrates the flow of fluid medium 52 from the injection nozzle 50' and through the lumen of the applicator portion 42 into the space between the insert frame 40 and the circuit board substrate 12 disposed within the enclosure (not shown). In this example, the fluid medium 52 is a hardenable fluid medium for use as an underfillayer that supports and secures the electrical contacts 20 and associated insert frame 20. As the fluid medium flows from the applicator portion 42, the medium fills the spaces between the electrical contacts below the frame until the underfill layer is complete, such as by dispensing a pre-determined amount of underfill material. After delivery, the fluid medium is allowed to dry, thereby forming the desired underfill layer. Although, in this example, the applicator portion 42 was used to deliver an underfill layer, it is appreciated that a similar applicator portion 42 could be used to deliver a variety of differing fluid mediums as needed. For example, the insert frame 40 could be used to deliver liquid solder, lubricant or other such fluid medium.

Figure 9:
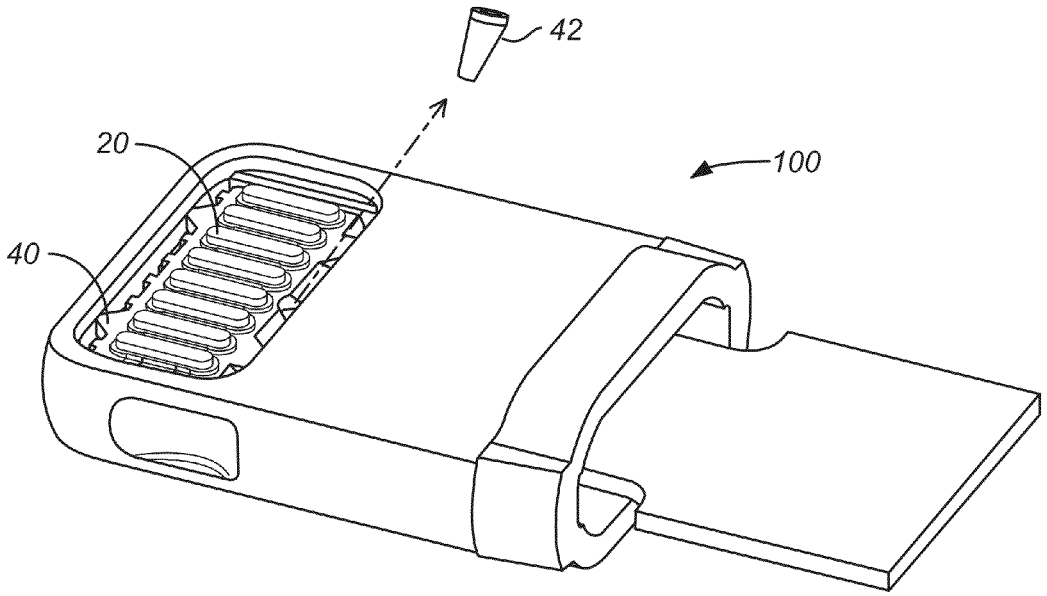
FIG. 9 illustrates an example connector plug after detachment of the applicator portion of the insert, in accordance with an embodiment of the present invention.

FIG. 9 shows an insert frame 40 having an applicator portion 42 of which at least a portion is detachable. The applicator portion 42, such as that shown in the example of FIG. 7B, may be entirely detachable so that the entire applicator portion 42 is removed after use, or the applicator portion 42 may be incorporated into the insert frame 20 such that the portion of the applicator portion extending above the insert frame 40 is detachable. The applicator portion 42 may be attached to the insert frame 40 at a detaching interface having reduced strength, such as an interface formed by scoring or perforations, so that the applicator portion 42 can be easily detached from the insert frame and discarded, as shown in FIG. 9. Alternatively, in some embodiments, the applicator portion 42 may be configured so that it is flush with, or does not extend so far above the insert frame 40 that removal is necessary.

Figure 10:
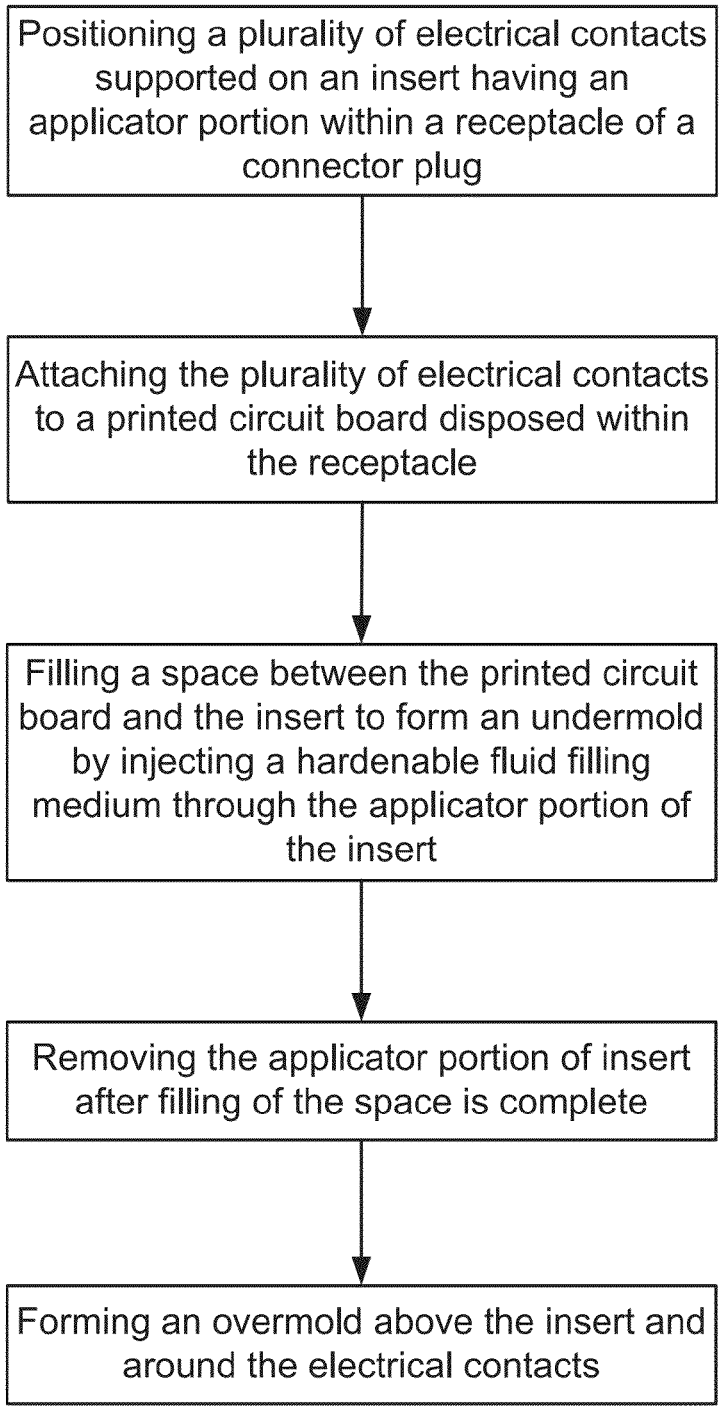
FIGS. 10-11 illustrate methods of assembling a connector plug in accordance with an embodiment of the present invention.
Figure 11:
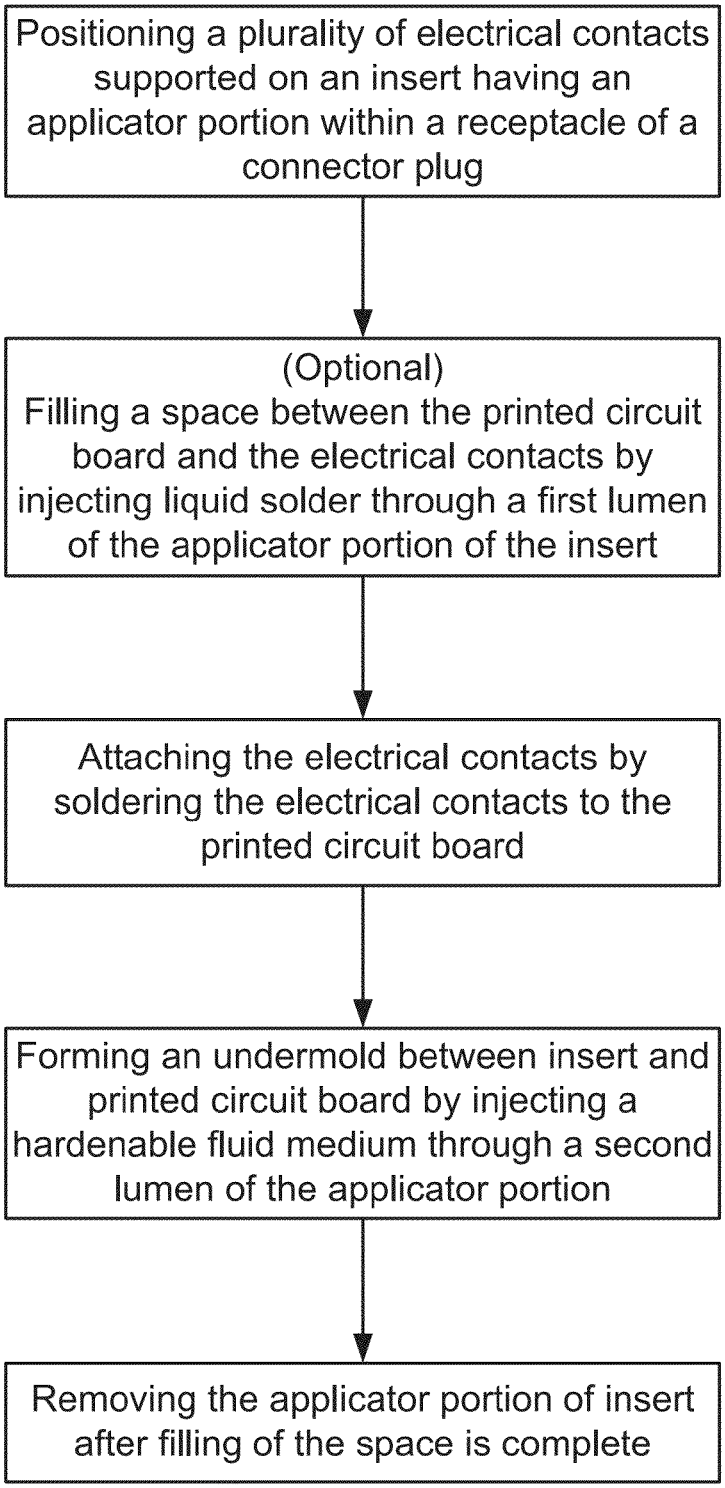

FIGS. 10-11 depict example methods of assembling a connector plug. In the method of FIG. 10, the method includes: positioning an insert having an applicator portion and a plurality of electrical contacts supported thereon within a receptacle of a connector plug; attaching the plurality of electrical contacts to a circuit board substrate disposed within the receptacle; filling a space between the circuit board substrate and the insert to form an undermold layer by injecting a hardenable fluid medium through the applicator portion of the insert; removing the applicator portion of the insert after filling of the space is complete; and forming an overmold over the insert and around the electrical contacts to complete assembly of the connector plug. In a connector plug tab having electrical contacts on both sides, the method may include depositing an underlayer around the electrical contacts on each side through an applicator portion of a respective insert supporting the electrical contacts on each side, then depositing an overmold layer around the electrical contacts on each side.

In some embodiments, the applicator portion 42 can be used to deliver multiple fluid mediums at differing locations for various purposes, and the applicator portion 42 may include multiple lumens corresponded to differing fluids mediums or different delivery locations. In the method of FIG. 11, the method includes: positioning a plurality of electrical contacts supported on an insert having an applicator portion within a receptacle of a connector plug; optionally filling a space between the circuit board substrate and the electrical contacts by injecting liquid solder through a first lumen of the applicator portion of the insert; attaching the electrical contacts by soldering the electrical contacts to the circuit board substrate; forming an undermold between the insert and circuit board substrate by delivering a hardenable fluid medium through a second lumen of the applicator portion 43; removing the applicator portion, applying an overmold and completing assembly of the connector plug.

The above described embodiments are intended to illustrate examples of certain applications of the invention in relation to electrical connectors, and does not so limit the invention to these embodiments. It is appreciated that any of the components described in any of the embodiments may be combined and or modified in accordance with the invention.

What is claimed is:

1. An insert for assembling electrical contacts within a receptacle of a connector plug housing, the insert comprising:

a dielectric insert having an upper side, a bottom side, and a plurality of openings for holding a plurality of electrical contacts therein; and an applicator portion having a lumen extending therethrough, the lumen extending from the upper side and through the lower side of the insert to facilitate flow of a fluid medium from an upper side of the insert to a space adjacent the bottom side.

2. The insert of claim 1 wherein the lumen of the applicator portion extends from an inlet opening of a first diameter dimensioned to receive a fluid filling nozzle to an exit opening having a second diameter dimensioned to facilitate flow of the filling medium into a space between the insert and the circuit board substrate, the first diameter being larger than the second diameter.

3. The insert of claim 1, wherein the applicator portion includes a plurality of exit openings to facilitate flow of the fluid medium to a plurality of locations between the insert and the enclosure.

4. The insert of claim 1, wherein the fluid medium comprises a hardenable fluid filling medium so as to fill and harden in a space between the frame and the enclosure to secure the electrical contacts within the enclosure.

5. The insert of claim 1, wherein the hardenable fluid filling medium is a dielectric thermoplastic so as to inhibit current flow between the electrical contacts.

6. The insert of claim 1, wherein the applicator portion includes a plurality of inlet openings.

7. The insert of claim 1, wherein the applicator portion extends a distance above the upper side of the insert when inserted within the enclosure so as to facilitate flow of the fluid medium through the inlet opening from above the insert.

8. The insert of claim 1, wherein the dielectric insert is configured to support the plurality of electrical contacts within a single row of spaced apart contacts, and wherein a portion of each of the plurality of electrical contacts extends through the bottom side when held within the plurality of openings to facilitate soldering of the plurality of electrical contacts to a circuit board substrate within the receptacle when the insert is placed therein.

9. The insert of claim 1, wherein the fluid medium comprises solder.

10. The insert of claim 1, wherein the applicator portion is removable from the insert.

11. The insert of claim 10, wherein the applicator portion is detachable along a detaching interface between the applicator portion and the insert, the detaching interface having reduced strength to facilitate removal of the applicator portion.

12. The insert of claim 11, wherein the detaching interface is scored and/or perforated.

13. A method of assembling a connector, the method comprising:

positioning an insert having a plurality of electrical contacts disposed therein in a receptacle of a connector plug housing on a circuit board substrate within the receptacle, wherein the insert comprises an applicator portion having a lumen extending therethrough;

attaching the plurality of electrical contacts disposed in the insert to the circuit board substrate so that a portion of each of the electrical contacts extending between the insert and the circuit board substrate are soldered to the circuit board substrate; and filling a space between the circuit board substrate and one or both of the insert and electrical contacts by injecting a fluid filling medium to the space through the lumen of the applicator.

14. The method of claim 13, wherein the fluid medium comprises a hardenable fluid filling medium to form an underfill layer around the electrical contacts and beneath the insert within the receptacle.

15. The method of claim 14, wherein the fluid medium comprises a dielectric injectable thermoplastic.

16. The method of claim 13, further comprising:

removing the applicator portion after filling of the space through the lumen.

17. The method of claim 16, further comprising:

filling a space above the insert with a hardenable overmold material after removal of the applicator portion.

18. The method of claim 13, wherein attaching the plurality of electrical contacts comprises soldering a bottom surface of the electrical contacts supported in the insert to the circuit board substrate disposed within the receptacle.

19. The method of claim 13, wherein filling the space comprises filling the space between the electrical contacts and the circuit board substrate by injecting fluid solder through the lumen of the applicator portion.

20. The method of claim 13, wherein the applicator portion comprises a plurality of lumens extending to a plurality of exit openings between the insert and the receptacle when the insert is disposed therein.

21. The method of claim 20, wherein filling the space comprises injecting the fluid medium into a single inlet opening, through the plurality of lumens and out the plurality of exit openings into the space.

22. The method of claim 13, wherein filling the space comprises injecting a fluid lubricant into a desired location beneath the insert.

23. The method of claim 13, wherein filling the space comprises injecting a first fluid medium through a first lumen of the applicator portion and subsequently injecting a second fluid medium through a second lumen of the applicator portion.

24. The method of claim 23, wherein the first fluid medium comprises a hardenable fluid medium and the second fluid medium comprises a catalyst to promote hardening of the fluid medium.

25. The method of claim 23, wherein the first fluid medium comprises liquid solder and the second fluid medium comprises a hardenable fluid medium.

* * * * *